US008774434B2

(12) United States Patent
Zhao et al.

(10) Patent No.: US 8,774,434 B2
(45) Date of Patent: Jul. 8, 2014

(54) SELF-ADJUSTABLE AND DEFORMING HEARING DEVICE

(76) Inventors: Yong D. Zhao, Simi Valley, CA (US); Jennifer Jinping Zhao, Simi Valley, CA (US)

( * ) Notice: Subject to any disclaimer, the term of this patent is extended or adjusted under 35 U.S.C. 154(b) by 308 days.

(21) Appl. No.: 13/286,642

(22) Filed: Nov. 1, 2011

(65) Prior Publication Data

US 2012/0134520 A1 May 31, 2012

Related U.S. Application Data

(60) Provisional application No. 61/409,336, filed on Nov. 2, 2010, provisional application No. 61/440,065, filed on Feb. 7, 2011.

(51) Int. Cl.
*H04R 25/00* (2006.01)

(52) U.S. Cl.
USPC ..... 381/328; 381/380

(58) Field of Classification Search
USPC ..... 381/328, 312, 380
See application file for complete search history.

(56) References Cited

U.S. PATENT DOCUMENTS 4,870,688 A * 9/1989 Voroba et al. ..... 381/328

* cited by examiner

*Primary Examiner* — Brian Ensey

(57) ABSTRACT

An in-ear hearing aid device that provides users with a customizable ear piece to fit the ear canal of any user. More specifically, the present invention can comprises of a hard case to hold all the electronics of the device with a hearing device jacket that envelops the device. An ear mold is connected to the jacket and allows the user to insert the device into the ear canal to enhance the user's hearing.

7 Claims, 3 Drawing Sheets

SELF-ADJUSTABLE AND DEFORMING HEARING DEVICE

The current application claims a priority to the U.S. Provisional Patent application Ser. No. 61/409,336 filed on Nov. 2, 2010 and the U.S. Provisional Patent application Ser. No. 61/440,065 filed on Feb. 7, 2011.

FIELD OF THE INVENTION

The present invention relates generally to a general purpose flexible ear hearing device or aid, more specifically, to an apparatus that can comfortably bend to comply with each unique ear canal shape.

BACKGROUND OF THE INVENTION

The present invention provides the hearing aids that can all be placed in the ear and has the following features: cosmetic hiding ability, and always maintain elastic contact with the ear canal, which can be placed closer to the human eardrum, comfortable to wear and stability, can be wear for long time, effectively reduce the feedback and the occlusion effect, clear sound transmission, reduce the device delivered gain loss. This hearing device is suitable for mild to severe hearing-impaired patients. Because this device can be bendable to comply with each individual ear canal curve and then comfortably sit inside the ear cannel so there is no need to take the ear impression to greatly reduce the hearing aid fitting process and time.

DETAIL DESCRIPTIONS OF THE INVENTION

All illustrations of the drawings are for the purpose of describing selected versions of the present invention and are not intended to limit the scope of the present invention.

Figure 1:
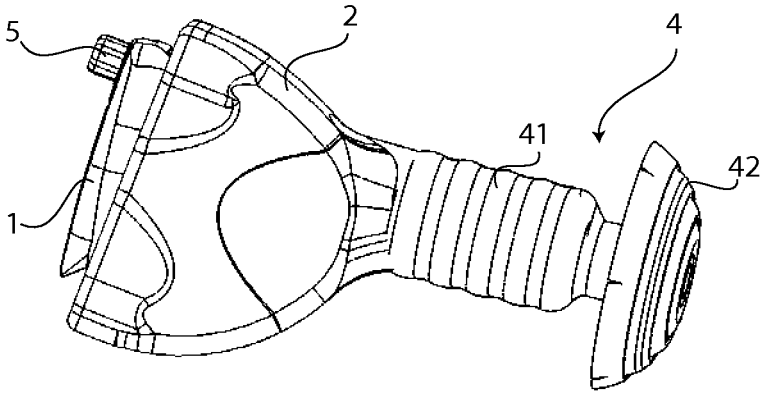
FIG. 1 is a front view of the present invention.

The present invention is a hearing aid that comprises of a hard case 1, a hearing device jacket 2, a receiver 3, and an ear mould 4. The present invention is uniquely designed to best conform to the ear canal of a user. In reference to FIG. 1-2, each of the components of the present invention are fitted together to form a compact and operable apparatus that can be comfortably placed into the ear canal.

Figure 3:
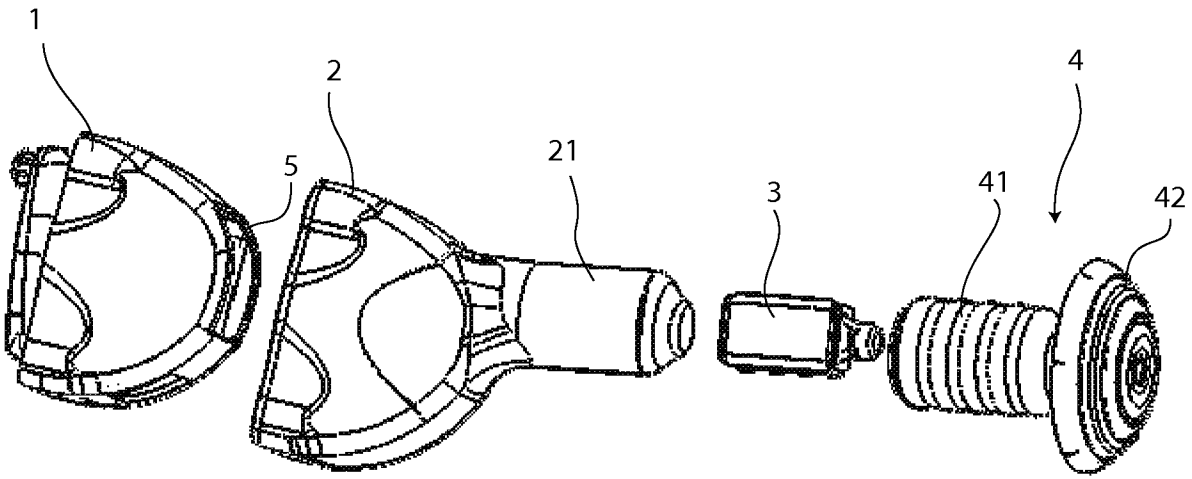
FIG. 3 is an exploded view of the present invention.

In reference to FIG. 3, the hearing device jacket 2 is the main structural component of the present invention that holds all of the other components together. The hearing device jacket 2 further comprises of a receiver boot 21. The hard case 1 is the component of the present invention that comprises of an electronic hearing device 5 and provides the present invention with the functionality of amplifying sounds for users with difficult hearing. The hard case 1 additionally functions to protect all of the internal electronics of the present invention. The electronic contained within the hard case 1 can include a microphone, a battery, a DSP chip, circuitry, and other components dependent on the hearing aid device. The hard case 1 is enveloped by and secured to the hearing device jacket 2. The hard case 1 is shaped to fit the outer ear of the user. As a result, the hearing device jacket 2 is completely conformed to and contoured to the shape of the hard case 1 to keep an overall compact size. The receiver boot 21 is a hollow extension that is extended from the hearing device jacket 2. The hollow space provided by the receiver boot 21 allows the receiver 3 to be directly connected to electronic hearing device 5. The receiver 3 is positioned in and enveloped by the receiver boot 21. Similar to the device hearing jacket, the receiver boot 21 is conformed to the shape of the receiver 3. The shape and extension of the receiver boot 21 allows the receiver 3 to traverse along the ear canal of the user's ear to place the receiver 3 as closely to the user's ear drum as possible. This design provides much more effective amplification by the hearing device for the user. As a result, the user is able to hear surrounding sounds more effectively.

Figure 2:
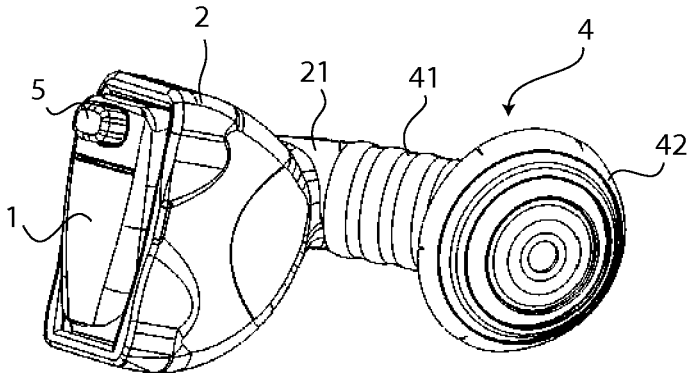
FIG. 2 is a front view of the present invention showing a bent receiver boot.

In reference to FIG. 2, the ear mould 4 comprises a tube and an ear tip 42. The tube 41 of the ear mould 4 is attached to the hearing device jacket 2 by means of the tube 41 being enveloped and adhered to the receiver boot 21. The ear tip 42 of the ear mould 4 is the portion of the ear mould 4 that is inserted into the ear and channels sound directly to the user's ear drums. The tube 41 of the ear mould 4 is soft and can be bent easily in the 3-D complex ear canal, especially the first and second sharp round turn sections of the ear canal.

Figure 4:
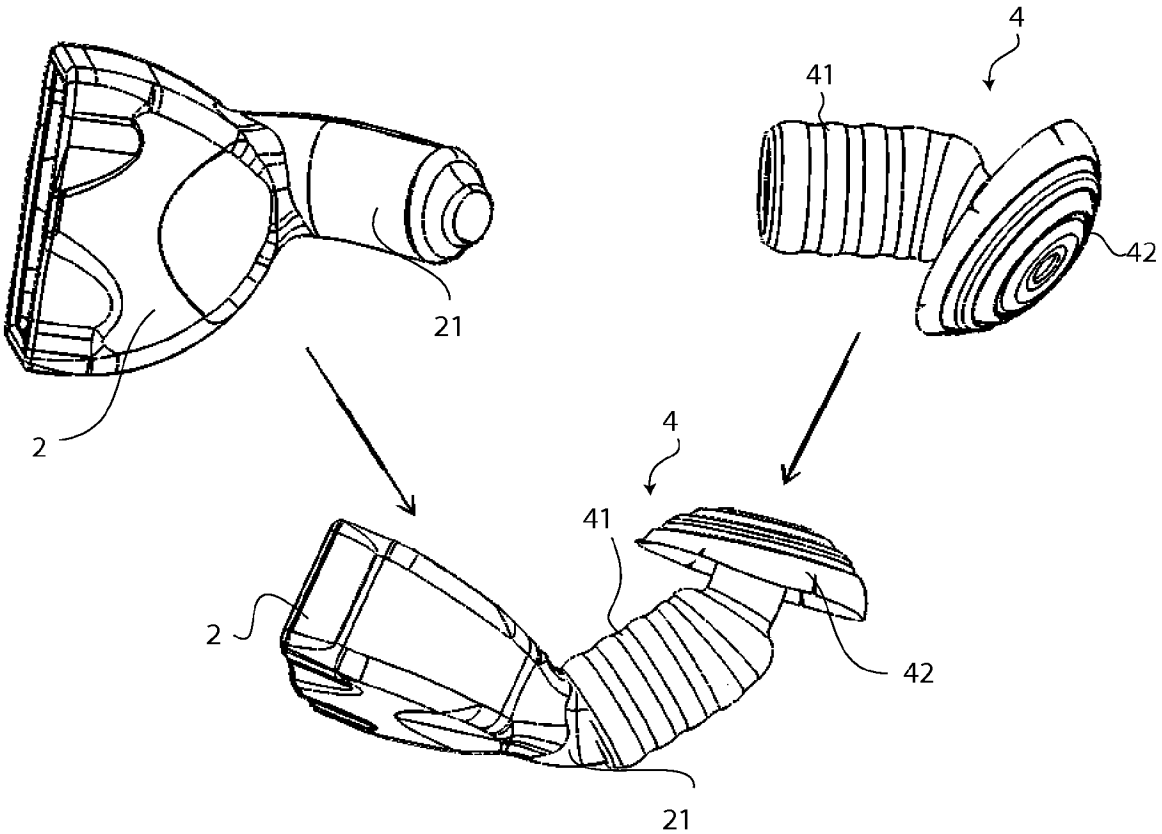
FIG. 4 is a view of the hearing device jacket and the ear mould being combined.

In reference to FIG. 4, the ear mould 4 is a soft ear mould that is shown in varying embodiments. In a preferred embodiment of the present invention, the soft ear-mound is made from a single of composite materials including medical or non-medical grade thermal plastic elastomer, silicone rubber, or non-metallic or metallic elastic material. The ear mould 4 can be compressed and comfortably fitted into the ear canal while maintaining acoustic pressure and keeping sufficient venting of the canal. The tube 41 of the ear mould 4 is structured to have a length and bent angle that conforms to the ear canal according to the anatomy and physiology of a human. Additionally, with each person having varying and uniquely shaped ear canals, the user is provided with the freedom to control the deformation of the ear mould 4 to best fit their ears. In another preferred embodiment of the invention, the described structure of the outer wall of the hose or the wall or the entire wall as a corrugated shape, or thread, straight or diagonal stripes in the shape of a stripe. The hearing device jacket 2 is manufactured with a molding process. The receiver boot 21 of the hearing device jacket is flexible. The hearing device jacket is molded over the hard case 1 to provide more comfort when being worn by a user. The hearing device jacket 2 can be shaped to have a round, oval, or polygonal cross-section to be placed over the hard plastic case. The hearing device jacket 2, similar to the ear mould 4, can be made from a single of composite materials including medical or non-medical grade thermal plastic elastomer, silicone rubber, or non-metallic or metallic elastic material. With the receiver boot 21 being manufactured with a flexible material, the hearing device is able to deform and conform to the shape of a user's ear canal. All of the components of the present invention can be manufactured by method of molding while each piece can be assembled and joined together by means of a bonding glue or thermal deforming.

The electronics of the hearing device can be any suitable technologies that are able to amplified sound to those with difficult hearing. Traditionally, the electronics of a hearing aid comprises of a microphone, an amplifier, a receiver/speaker, and a battery. With the hearing aid device inserted into the user's ear canal, the microphone is able to pick up the surrounding sounds of the user. The microphone converts the sounds into electrical signals and transmits it to the amplifier. The amplifier is able increase the volume of the signal to be sent to the receiver/speaker. The receiver/speaker then converts the electrical signal of the sounds back into sound waves and emits it directly to the user's ear drums. The battery within the hearing aid provides power to the receiver/speaker, the amplifier, and the other circuitry to allow the hearing aid to perform its functionalities. In the preferred embodiment of the present invention, the receiver 3 is connected indirectly to the hard case 1 to provide maximum flexibility to allow the device to conform to the user's ear canal. However, in other embodiments of the present invention, the receiver 3 can be directly docked and extended from the hard case 1.

The hard case 1 and the hearing device jacket 2 of the present invention can be manufactured to be an in-the-ear (ITE) hearing device, an in-the-canal (ITC) hearing device, a completely-in-the-canal (CIC) hearing device, or a behind-the-ear (BTE) hearing device. However, in the preferred embodiment of the present invention, the device is manufacture as an in-the ear hearing device. Hearing aid devices such as the ITE, ITC, and the CIC hearing aid device allow the user to conceal the hearing device as much as possible. Each of the different types of hearing aid devices can provide hearing aid for users of varying degrees of hearing loss. However, the present invention can be manufactured to be suitable for users with any degrees of hearing loss.

Although the invention has been explained in relation to its preferred embodiment, it is to be understood that many other possible modifications and variations can be made without departing from the spirit and scope of the invention as hereinafter claimed.

What is claimed is:

1. An in-ear hearing device with directional-detachable sound delivery system comprises,
- a hard case;
- a hearing device jacket;
- a receiver;
- an ear mould;
- the hearing device jacket being enveloped about and secured to the hard case;
- the hearing device jacket comprises a receiver boot;
- the receiver boot being extended from the hearing device jacket;
- the receiver being positioned in and enveloped by the receiver boot;
- the hearing device jacket is made from a malleable material selected from the group consisting of medical grade thermal plastic elastomers, or silicone rubber; and
- the tube being angled to conform to an ear canal.

2. The in-ear hearing device with directional-detachable sound delivery system as claimed in claim 1 comprises,
- the ear mould comprises a tube and an ear tip;
- the ear mould being attached to the hearing device jacket by means of the tube being enveloped about the receiver boot; and
- the tube being extended from the ear tip.

3. The in-ear hearing device with directional-detachable sound delivery system as claimed in claim 1 comprises,
- an electronic hearing device; and
- the electronic hearing device being positioned inside the hard case.

4. The in-ear hearing device with directional-detachable sound delivery system as claimed in claim 1 comprises,
- the tube being angled to conform to an ear canal.

5. An in-ear hearing device with directional-detachable sound delivery system comprises,
- a hard case;
- a hearing device jacket;
- a receiver;
- an ear mould;
- the hearing device jacket being enveloped about and secured to the hard case;
- the hearing device jacket comprises a receiver boot;
- an electronic hearing device;
- the electronic hearing device being positioned inside the hard case;
- the receiver boot being extended from the hearing device jacket;
- the receiver being positioned in and enveloped by the receiver boot;
- the ear mould comprises a tube and an ear tip;
- the hearing device jacket is made from a malleable material selected from the group consisting of medical grade thermal plastic elastomers, or silicone rubber; and
- the tube being extended from the ear tip.

6. The in-ear hearing device with directional-detachable sound delivery system as claimed in claim 5 comprises,
- the ear mould being attached to the hearing device jacket by means of the tube being enveloped about the receiver boot.

7. An in-ear hearing device with directional-detachable sound delivery system comprises,
- a hard case;
- a hearing device jacket;
- a receiver;
- an ear mould;
- the hearing device jacket being enveloped about and secured to the hard case;
- the hearing device jacket comprises a receiver boot;
- an electronic hearing device;
- the electronic hearing device being positioned inside the hard case;
- the receiver boot being extended from the hearing device jacket;
- the receiver being positioned in and enveloped by the receiver boot;
- the ear mould comprises a tube and an ear tip;
- the ear mould being attached to the hearing device jacket by means of the tube being enveloped about the receiver boot;
- the tube being extended from the ear tip;
- the hearing device jacket is made from a malleable material selected from the group consisting of medical grade thermal plastic elastomers, or silicone rubber; and
- the tube being angled to conform to an ear canal.

* * * * *